US005362295A

United States Patent [19]

Nurge

[11] Patent Number: 5,362,295

[45] Date of Patent: Nov. 8, 1994

[54] EXERCISE BELT SYSTEM

[76] Inventor: William Nurge, P.O. Box 2468, Ketchum, Id. 83340

[21] Appl. No.: 21,377

[22] Filed: Feb. 23, 1993

[51] Int. Cl.[5] ..... A63B 21/02

[52] U.S. Cl. ..... 482/124; 482/121; 482/49

[58] Field of Search ..... 482/13, 126, 121, 124, 482/44, 49, 74, 91, 114, 120, 129, 148, 907; 2/59, 170; 273/26 C

[56] References Cited

U.S. PATENT DOCUMENTS

| | | | |
|---|---|---|---|
| 1,402,179 | 1/1922 | Piscitelli | 482/124 |
| 1,432,013 | 10/1922 | Blake . | |
| 1,506,631 | 8/1924 | Grover . | |
| 2,097,376 | 10/1937 | Marshman . | |
| 4,441,707 | 4/1984 | Bosch . | |
| 4,540,173 | 9/1985 | Hopkins, Jr. . | |
| 4,544,155 | 10/1985 | Wallenbrock et al. . | |
| 4,685,671 | 8/1987 | Hagerman et al. . | |
| 4,728,103 | 3/1988 | Fulton . | |
| 4,733,862 | 3/1988 | Miller | 482/126 |
| 4,779,867 | 10/1988 | Hinds . | |
| 4,815,731 | 3/1989 | Suarez et al. | 482/124 |
| 4,856,112 | 8/1989 | Effle | 2/59 |
| 4,961,573 | 10/1990 | Wehrell . | |
| 5,023,754 | 4/1993 | Maclean | 482/124 |
| 5,129,647 | 7/1992 | Castellanos | 482/124 |
| 5,141,223 | 8/1992 | Block . | |
| 5,186,701 | 2/1993 | Wilkinson | 482/124 |
| 5,190,512 | 3/1993 | Curran | 482/124 |

FOREIGN PATENT DOCUMENTS 20463 of 1908 United Kingdom .

OTHER PUBLICATIONS

Documents relating to "Walk 'N Tone" product of SPRI Products, Inc., including photocopies of product package and photograph of product.

*Primary Examiner*—Stephen R. Crow
*Assistant Examiner*—Jerome Donnelly
*Attorney, Agent, or Firm*—Jenner & Block

[57] ABSTRACT

A novel exercise system is disclosed which is especially useful for effectively exercising the musculature of the upper body while simultaneously performing a lower body aerobic activity. The system includes a belt, a variety of elastic cords and a variety of hand grips, ankle straps and foot straps. Variable resistance is provided by an elastic cord which is free to slide about the user's waist. The elastic cords are provided with cliphooks at each end, which allows them to be easily attached to and detached from the belt and the straps. Additionally, a novel wrist attachment is disclosed which is easy for the user to put on and eliminates the need for the user to firmly grip a handle or hand grip while exercising.

20 Claims, 4 Drawing Sheets

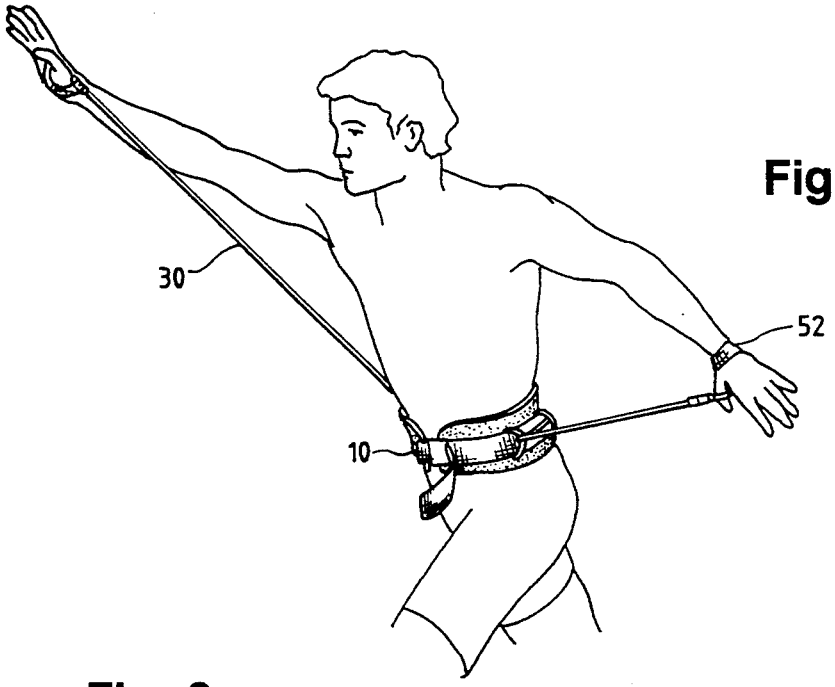
Fig. 8
Fig. 9
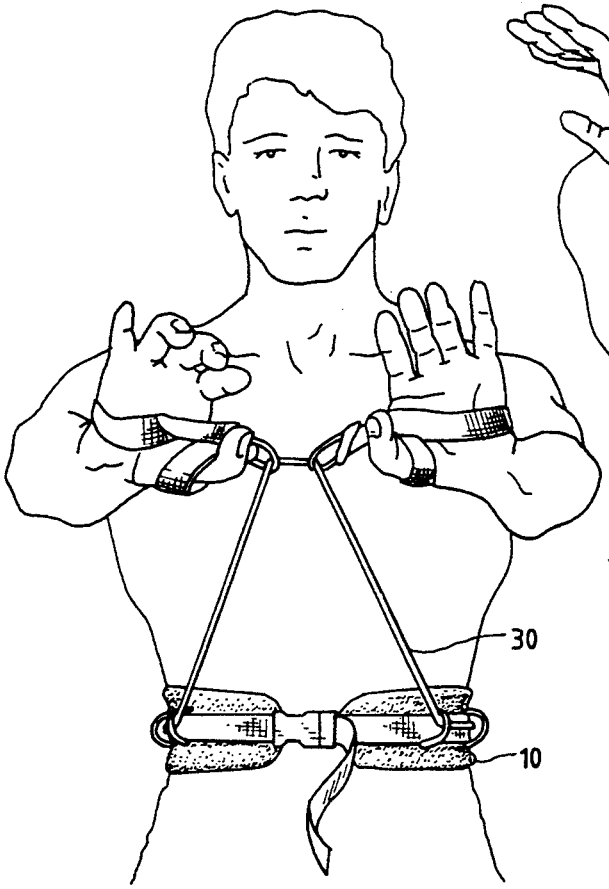
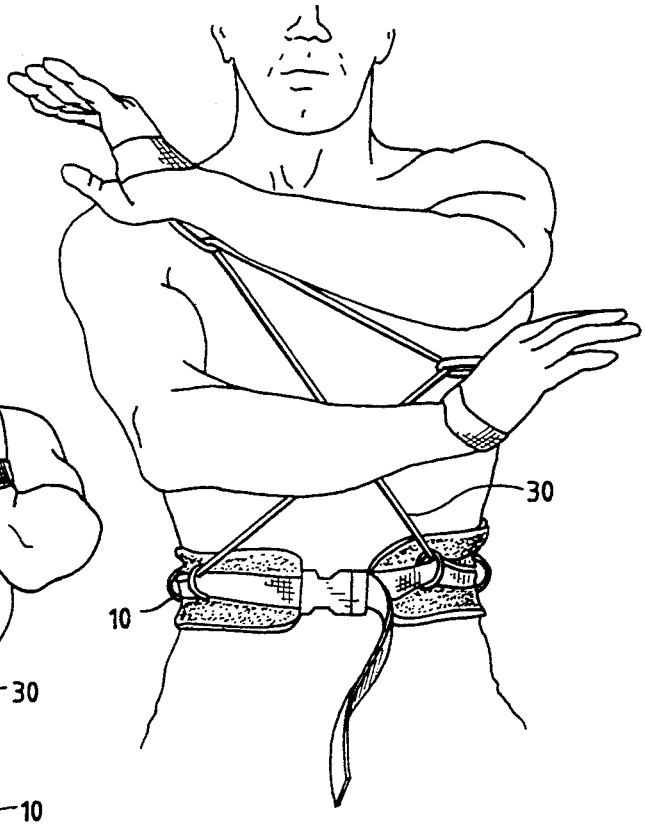
Fig. 10

EXERCISE BELT SYSTEM

FIELD OF THE INVENTION

This invention relates to exercise equipment, and particularly to a portable exercise device especially useful for effectively exercising the muscles of the upper body while simultaneously performing a lower body aerobic activity.

BACKGROUND OF THE INVENTION

Physical fitness is recognized as essential to good health and longevity. Exercise, and particularly aerobic exercise, is an important element in achieving and maintaining physical fitness. For example, one of the leading causes of death in the United States is heart disease. Numerous studies have shown that consistent aerobic exercise will significantly reduce the risk factors associated with heart disease.

Aerobic exercise is available through many sports and activities, each with certain advantages and limitations. Cross-country skiing has long been regarded by fitness experts as one of the best overall aerobic activities because it is a total body endurance sport that aerobically conditions both the upper and lower body. Unfortunately, only a relatively small number of people have access to cross-country ski areas, and the sport is, of course, subject to season and weather. There are cross-country ski simulators, but those currently available require a high level of skill to use, are expensive, and provide resistance through a limited range of motion which reduces the effectiveness of the activity.

Other activities are more widely available. Currently, the most popular modes of aerobic exercise are walking, jogging, aerobic dance, stairstepping, and stationary cycling. Although these activities are beneficial if performed regularly, they do little to aerobically condition or tone the muscles of the upper body.

In an effort to increase the effectiveness of such activities, some individuals have used hand-held weights. However, several studies have shown that handweights are ineffective in enhancing weight loss or significantly improving cardiovascular parameters. Further, because of the ballistic nature of the forces involved, handweight users are more prone to shoulder injuries.

There have also been a variety of devices which include belts and elastic members with hand grips intended for use either alone or in conjunction with lower body activities, but none of these devices have proved entirely suitable in terms of effectiveness, safety and convenience. These devices do not allow the elastic members to be easily attached to and detached from both the belt and the handle or strap, thus making it difficult to change the resistance of the elastic members or to adapt the device for a variety of different exercises. Some devices have a flexible, non-elastic line which slides around the user's waist when the arms are alternately moved in a reciprocal motion, while others have non-sliding elastic cords fixed to a belt. These arrangements limit the range of motion, do not provide variable resistance based on whether one or both arms are extended, and do not allow flexibility of use in a wide variety of exercises.

Another problem with such known devices is that they have handles or hand grips which the user is required to firmly grip during use. Frequent use of such hand grips can cause overuse injuries in the wrist joint and the muscles responsible for gripping and hand movement. Conventional handles are difficult to use for individuals with hand or lower arm injuries such as carpal tunnel syndrome or "tennis elbow." They are also not recommended for cardiac rehabilitation patients or other persons with a heart condition, as statically tensing the muscles of the hands and forearms while performing aerobic exercise may result in coronary thrombosis. Conventional handles are also not adjustable to properly fit different sized hands.

Finally, the plain elastic members previously known are subject to wear and do not have sufficient elasticity to permit a full range of motion.

SUMMARY OF THE INVENTION

The present invention, when used in conjunction with any of the aforementioned lower body activities, affords simultaneous exercise of the muscles of the upper body and produces cardiovascular improvements and muscle toning benefits similar to those provided by cross-country skiing. Because the upper and lower body muscles are exercised simultaneously, the invention enables the user to obtain the maximum benefit in the least amount of time. The system of the invention is lightweight, compact and portable, and thus it can be easily transported and used wherever and whenever it is most convenient. Regular use will provided total body aerobic conditioning and improvements in strength and muscle size.

The invention overcomes the problems of the devices previously known in the art by providing an elastic cord which is free to slide about the user's waist. The combination of sliding and elasticity provides variable resistance depending upon whether one or both arms are extended at a given time. The use of an elastic cord to provide resistance in lieu of weights offers progressive resistance through a full range of motion, provides a more effective aerobic workout and reduces the risk of shoulder injuries that can result from the use of handweights.

The elastic cords are provided with cliphooks at each end, which allows them to be easily attached to and detached from the belt and the wrist straps or other attachments. Thus, worn elastic elements can be conveniently replaced and different resistances can be provided. The elastic cords can be used for the sliding motion or can be clipped to loops on the belt, and they can be attached to wrist straps, handles, ankle straps and other such devices for different types of exercises. Cords of different lengths and resistance can be attached to a number of points on the belt, thus allowing optimization of the angle and intensity of resistance to most effectively exercise the intended muscle groups. The elastic cords themselves have an ultimate elongation percentage of 180% or more to allow the user a full range of motion, for example, to fully extend both arms simultaneously. The elastic cords are covered with a smooth fabric to reduce friction and wear.

The invention also provides a wrist attachment which is easy for the user to put on, is adjustable to properly fit each user, and eliminates the need for the user to firmly grip a handle or hand grip while exercising. The wrist attachment includes a thumb or finger loop which provides a low but sufficient force anchor to prevent slippage and undesirable movement of the wrist attachment or the wrist during use. Additionally, the loop aids in orienting and holding the device during attachment and allows the opposite hand alone to perform the necessary encircling and attachment movements. These features overcome the problems inherent with conventional handles as previously discussed by placing the load at or below the wrist joint, thus freeing the user's hands. This reduces injuries associated with gripping and makes the system more comfortable to use.

The belt of the invention is provided with a wide, compressible pad in the back to provide significant support to the postural muscles of the trunk while exercising.

It is therefore an object of the invention to provide a lightweight, compact, portable, inexpensive and convenient device for effectively exercising the upper body while simultaneously performing a wide variety of lower body aerobic activities.

It is also an object of the invention to provide a device which enables the user to perform a variety of exercises and to achieve variable levels of resistance depending upon whether one or both arms are extended at a given time.

It is also an object of the invention to provide an upper body exercise device which does not require the user to firmly grip a handle or hand grip during use and which aids the user in attaching the device to the hand or arm.

BRIEF DESCRIPTION OF THE DRAWINGS

FIG. 8 illustrates the fully extended position of the front/rear alternate arm motion.

FIG. 9 shows a configuration of the belt and elastic cord used to isolate and exercise certain muscle groups.

FIG. 10 illustrates a configuration of the belt and elastic cord for use with a cross-arm movement to isolate and condition certain muscle groups.

DETAILED DESCRIPTION OF THE INVENTION

Figure 1:
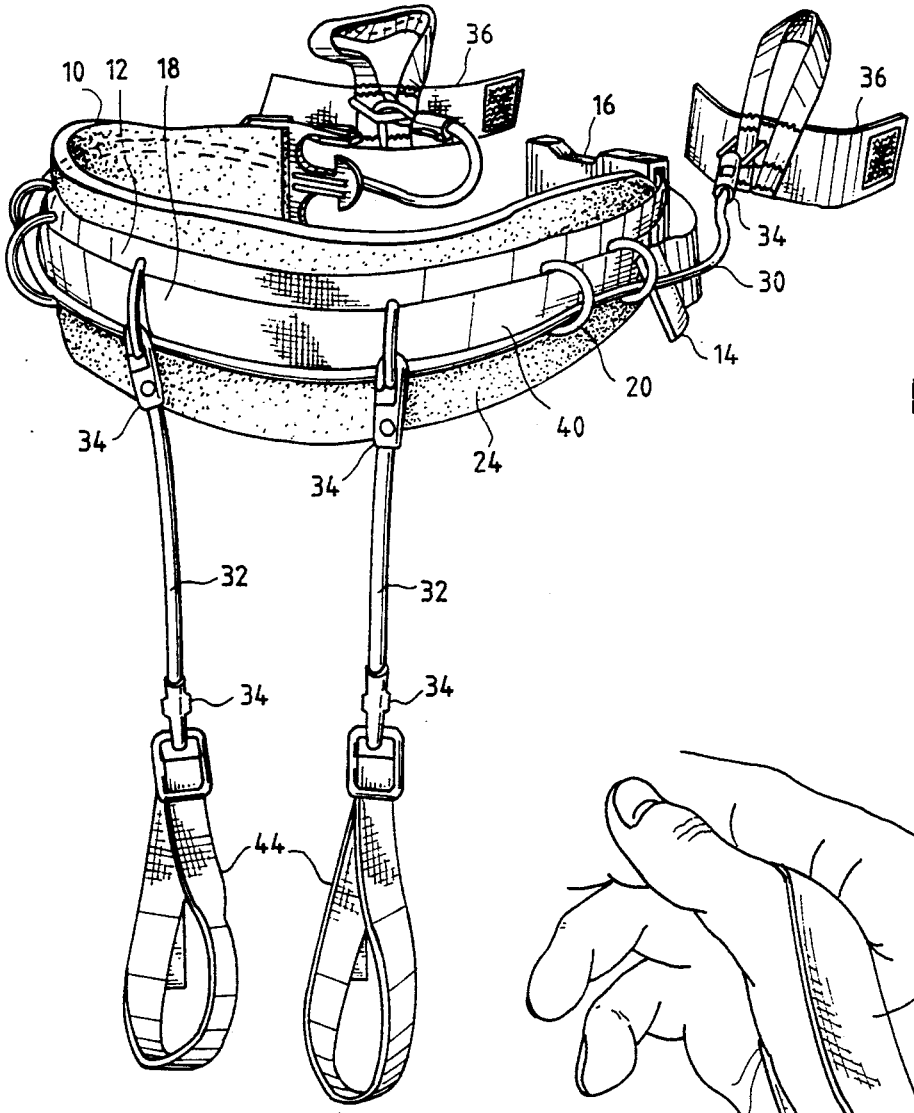
FIG. 1 is a perspective view of the preferred embodiment of the invention showing the belt, the sliding elastic cord with cliphooks and wrist straps, and a pair of elastic cords with cliphooks and hand or foot straps.

The preferred embodiment of the multi-purpose exercise device of the invention is shown in FIG. 1. The device includes belt 10 which is of a suitable length to completely encircle the waist of a user. Belt 10 is composed of a piece of nylon webbing 12 approximately 2 inches in width. Each end 14 of webbing 12 extends and loops through the male and female parts of buckle 16, enabling the user to easily adjust and secure belt 10 about his waist.

On one side of webbing 12 a section of narrower webbing 18, about 1 inch in width, is used to secure attachment loops 20 at various locations along the length of webbing 12 by sewing through each attachment loop 20 and narrower webbing 18 to webbing 12, preferably using high tensile strength nylon thread. In the embodiment shown in FIG. 1, six attachment loops 20 are attached in this manner at 3, 6 and 9 inches from either side of the centerline of webbing 12. Attachment loops 20 are sewn in place such that they are securely fastened to webbing 12 but can pivot along the longitudinal axis of belt 10.

As shown in FIG. 1, back pad 24 is sewn to the inner side of webbing 12 and is sized to partially encircle the user's waist. Pad 24 is preferably made of a resilient material such as neoprene and provides support to the postural muscles of the trunk while the user is exercising. In the example shown, pad 24 is 4 to 6 inches wide in the center, i.e., the user's back, and tapers to approximately 2½ inches at each end, at the user's sides, for maximum support and comfort. A thickness of approximately 3/16 to 7/16 inch and the fairly high density of the neoprene material have been found to provide an optimal balance of support, cushioning and comfort to the user. Webbing 12 with attachment loops 20 is sewn to pad 24, preferably using high tensile strength nylon thread. In the preferred embodiment, pad 24 has a thin fabric covering such as Lycra and a thin nylon binding sewn around the edges for increased comfort and a neat appearance. In another embodiment, a material having a high surface tension such as the loop portion of a hook-and-loop (Velcro) fastening material is sewn to the inside surface of pad 24 to reduce slippage of belt 10 about the user's waist during vigorous exercise.

Elastic cords of various lengths and resistance are provided to facilitate a wide variety of exercise motions. For example, FIG. 1 shows a longer elastic cord 30 which passes through attachment loops 20 so as to be free to slide about the user's waist, and shorter elastic cords 32 for direct attachment to attachment loops 20. Each elastic cord 30, 32 is provided with a cliphook 34 at each end. Attachment loops 20 may be plastic or steel D-rings of approximately 1 inch in diameter, or sufficient in size to allow elastic cord 30 and cliphooks 34 to pass freely through, or to permit cliphooks 34 to readily attach directly to any attachment loop 20.

FIG. 1 illustrates the attachment of resistance cords for two modes of use of belt 10. For a sliding motion to simulate cross-country skiing, elastic cord 30 is passed through attachment loops 20. A cliphook 34 at each end of elastic cord 30 is clipped to an attachment ring 20 on a wrist strap 36 or other handle or grip. The user can then apply reciprocating force by moving his arms back and forth, causing elastic cord 30 to both elongate and slide back and forth through attachment loops 20. For other exercises, elastic cords 32 may be clipped at one end to an attachment loop 20 on belt 10 and at the other end to an attachment ring 38 on a wrist strap 36 or other handle or grip. Various configurations of elastic cords 30,32 for a variety of exercises are described in more detail below.

A strip of low surface tension material 42 such as nylon pack cloth or thin plastic may be sewn over narrower webbing 18 for reducing friction. In the alternative, a length of flexible plastic tubing may be slipped over narrow webbing 18 and through attachment loops 20 before narrow webbing 18 is sewn down to webbing 12. The middle section of narrow webbing 18 which passes through the plastic tubing is not sewn down to webbing 12, thus forming a loop near the center or back portion of belt 10 to which carrying pouches of various design may be attached. Various carrying pouches can be designed to accommodate, for example, a water bottle, personal audio device, medication or other personal items. If the plastic tubing is not used, carrying pouches and other accessories can simply be connected to attachment loops 20.

Elastic cord 30 is preferably composed of a plurality of elongated elastomeric filaments which are encased in a friction-resistant flexible material threaded in such a way as to allow the entire elastic cord to stretch to approximately 2.5 to 3 times its original length repeatedly without breakage or significant deterioration. Alternately, elastic tubing may be used. Elastic cords 30,32 are provided in various lengths and resistances to accommodate the physical size, fitness level and exercise goals of the user. In the embodiment shown, elastic cord 30 is approximately 32 inches long so that when passed through all of attachment loops 20 on belt 10 approximately 4 to 10 inches of elastic cord 30 will protrude forward from either of the forwardmost attachment loops 20. Cliphooks 34 can be attached to attachment rings 38 on wriststraps 36. In this configuration, the user then can simultaneously fully extend both arms in any direction for the purpose of providing resistance to the upper body musculature.

There are numerous orientations of elastic cord 30 with respect to attachment loops 20 which are dependent upon the muscles desired to be overloaded, and the angle and intensity of resistance necessary for the most effective overload. In the configuration shown in FIG. 1, elastic cord 30 is passed through all six of attachment loops 20 and cliphooks 34 at each end are attached to wrist straps 36. With this arrangement, the majority of upper body muscles can be effectively overloaded. If, instead, the cliphook ends of elastic cord 30 pass through only the innermost two or four attachment loops 20, the resistance to the upper body musculature is significantly reduced. The user can also vary the resistance by using elastic cords of different diameters. Larger diameter cords will have a higher resistance due to the greater number of elastomeric filaments within the covering.

Finally, a unique aspect of the invention is that the resistance can be varied depending upon whether one or both arms are extended, and thus a single device is effective for two distinct types of training. The resistance provided to the muscles during any given arm movement is greater when both arms are extended simultaneously than when one arm is extended at a time. This feature allows the user either to aerobically overload (i.e., many repetitions, low resistance) the upper body musculature by extending one arm at a time, or to strength train (fewer repetitions, high resistance) the upper body musculature by extending both arms simultaneously. This unique variable resistance feature is due to the fact that elastic cord 30 has a high ultimate elongation and is allowed to unrestrictedly slide along the longitudinal axis of belt 10.

Due to the inherent physical properties of elastic cord and tubing, the effective lifespan of the elastomeric member is relatively short, on the order of less than 50 hours of use. A benefit of the invention is that the elastic cords can be quickly, easily and inexpensively replaced without also replacing other parts of the system such as belt 10 and wrist straps 36, which are far more durable.

The embodiment shown in FIG. 1 is also provided with elastic cords 32 with cliphooks 34 at each end. One cliphook 34 of each cord 32 is clipped to an attachment loop 20 on belt 10, and the other end is clipped to a combination buckle/attachment ring 42 on hand/foot strap 44. In this embodiment, elastic cords 32 are latex tubing having a wall thickness of approximately 3/16 inch, inner diameter of approximately ⅛ inch, and an ultimate elongation percentage of 600% or more. As is the case with cliphooks 34 on elastic cord 30, cliphooks 34 on elastic cords 32 can also be easily attached to or detached from, or passed through, any of attachment loops 20 or attachment rings 38,42 on belt 10, wrist straps 36 or hand/foot straps 44. This permits them to be connected in many configurations for a variety of exercises. For example, as configured in FIG. 1, foot straps 44 are to be looped around the user's feet and thereby enable the user to train the lower body musculature while simultaneously exercising the upper body with elastic cord 30 attached to wriststraps 36. Hand-/foot straps 44 are made of nylon webbing approximately one inch wide, are adjustable to fit the user's hands and feet by means of buckle 42, which also serves as an attachment ring. They may be used about the hand, wrist, ankle or foot, as desired.

Figure 2:
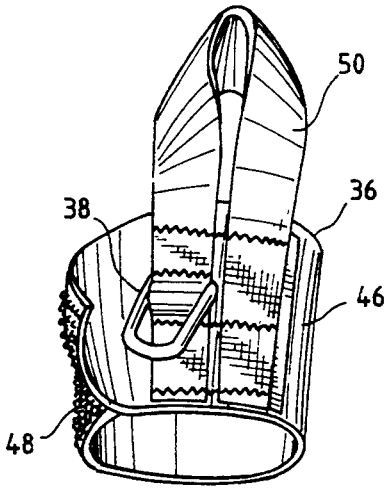
FIG. 2 is a view of the wrist strap of the invention.

FIG. 2 shows the preferred embodiment of wriststrap 36, which is composed of a strap 46 of resilient material such as neoprene with a thin fabric cover for comfort. Strap 46 is approximately 2 inches wide and is secured around the user's wrist with hook-and-loop fasteners 48 (Velcro). Loop 50 of strong fabric webbing is sewn to strap 44, as is attachment ring 38.

Figure 3:
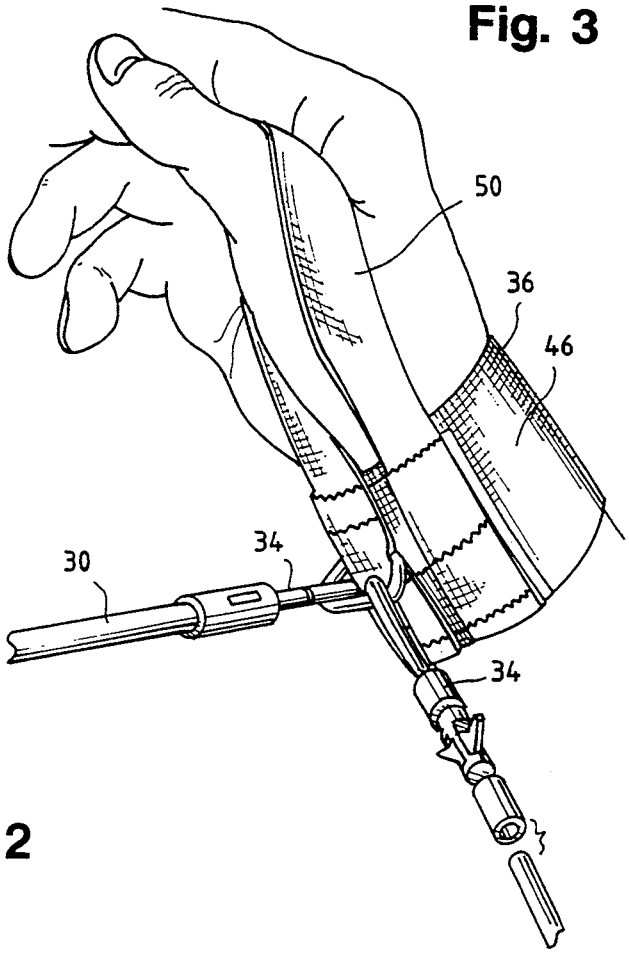
FIG. 3 illustrates placement of the wrist strap on the user's wrist and attachment of elastic cords.

FIG. 3 shows wrist strap 36 as worn on a user's wrist. Loop 50 is placed around the user's thumb, holding wriststrap 36 in position while the user secures it about his wrist and reducing movement during use. One or more elastic cords 30,32 may be attached to attachment ring 38 by cliphooks 34 as shown.

Figure 4:
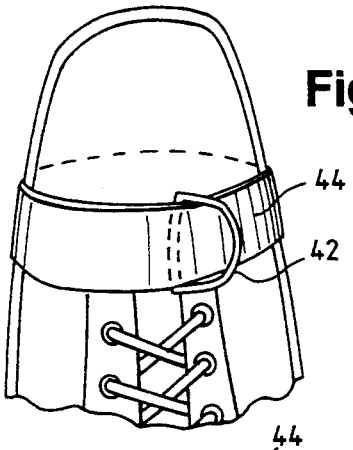
FIG. 4 is a view of the hand and foot strap of the invention showing use as a foot strap.
Figure 5:
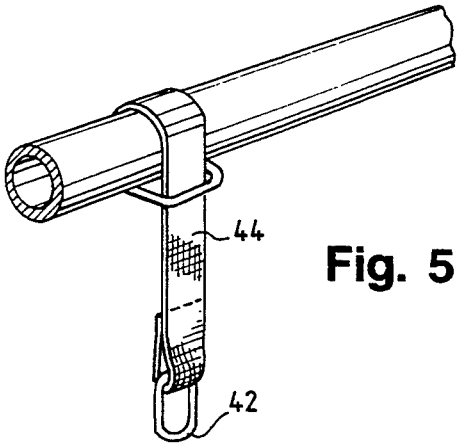
FIG. 5 illustrates use of the hand and foot strap for attachment to a fixed bar.
Figure 6:
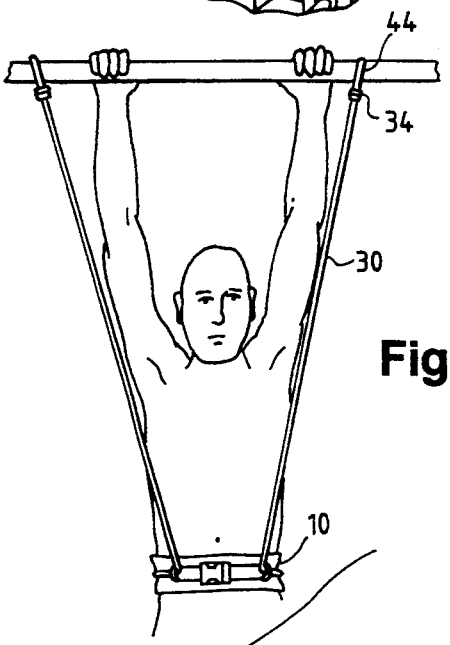
FIG. 6 illustrates an exercise which may be performed using the invention and a fixed horizontal bar.

FIG. 4 illustrates use of hand/foot strap 44 on the user's foot. FIG. 5 illustrates use of hand/foot strap 44 for attaching an elastic cord 30,32 to a fixed object such as a horizontal bar, for example, to use in conjunction with pull-up exercises as shown in FIG. 6.

Figure 7:
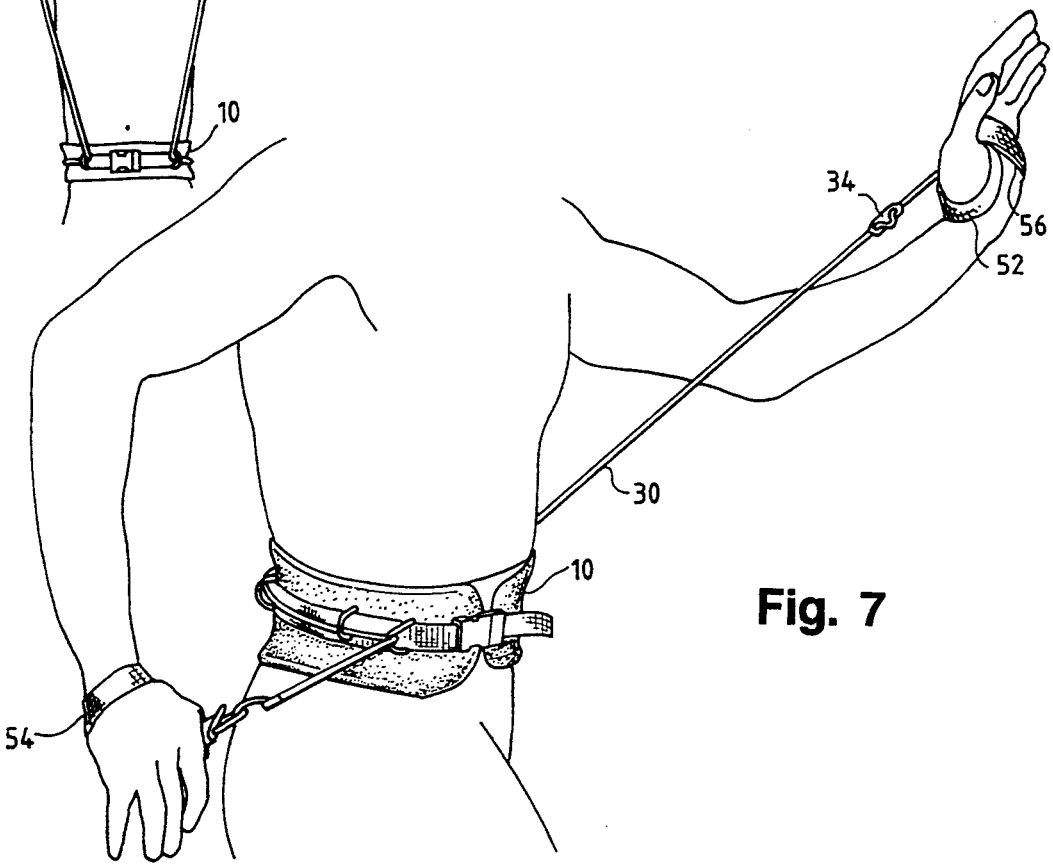
FIG. 7 illustrates use of the invention with the sliding elastic cord for front/rear alternate arm motion.

FIGS. 7 and 8 illustrate use of the invention with sliding elastic cord 30 to simulate the motions of cross-country skiing. FIG. 7 shows the transition phase of the front/rear alternate arm motion which is one of the most commonly used and effective movements for aerobically conditioning and toning the upper body musculature while simultaneously performing a lower body aerobic activity such as aerobic dance, stairstepping, walking, running or stationary cycling. Because elastic cord 30 is capable of both sliding along the longitudinal axis of belt 10 and elastically elongating, the user can simultaneously overload the forward and rear extending arms through their full range of motion. FIG. 7 shows the early phase of rear arm extension while FIG. 8 illustrates the fully extended position of the front/rear alternate arm action.

FIGS. 7 and 8 also show another embodiment of a hand grip 52. Hand grip 52 is formed by looping a piece of nylon webbing 54 through one end of a ladderlock and D-ring and sewing webbing 54 onto itself. The free end of webbing 54 is passed through a 3 to 6 inch long piece of sturdy but flexible compressible tubing 56 and then up and through the locking section of the ladderlock. Tubing 56 provides the user the option of gripping or relaxing the muscles of the hand while exercising. Webbing 54 can be easily adjusted to securely fit various hand sizes and thereby enable the user to exercise the upper body with a relaxed open hand. Users who desire static hand and forearm strength can grip onto resiliently compressible tubing 56.

FIGS. 9 and 10 illustrate another configuration for use of the invention to isolate and overload a variety of selected muscle groups. Cliphook 34 at one end of elastic cord 30 is attached to one of the side attachment loops 20 on belt 10, the opposite cliphook end is passed through the remaining attachment loops 20 on belt 10 and the attachment rings of both hand straps and then connected to the same attachment loop 20 as the first cliphook 34. FIG. 9 shows a front/rear arm action with simultaneous lateral tension which will condition the pectoral (chest) muscles, deltoids (shoulders), triceps, rhomboids, teres major and latissimus dorsi. FIG. 10 illustrates use of the same configuration wherein the user performs an arm cross movement to isolate and overload the pectoral and anterior deltoid muscles. It will be appreciated that using this arrangement of belt 10, elastic cord 30 and hand straps 44 or wriststraps 36, there are numerous arm movements which can be performed which will effectively isolate and overload selected muscle groups.

Figure 11:
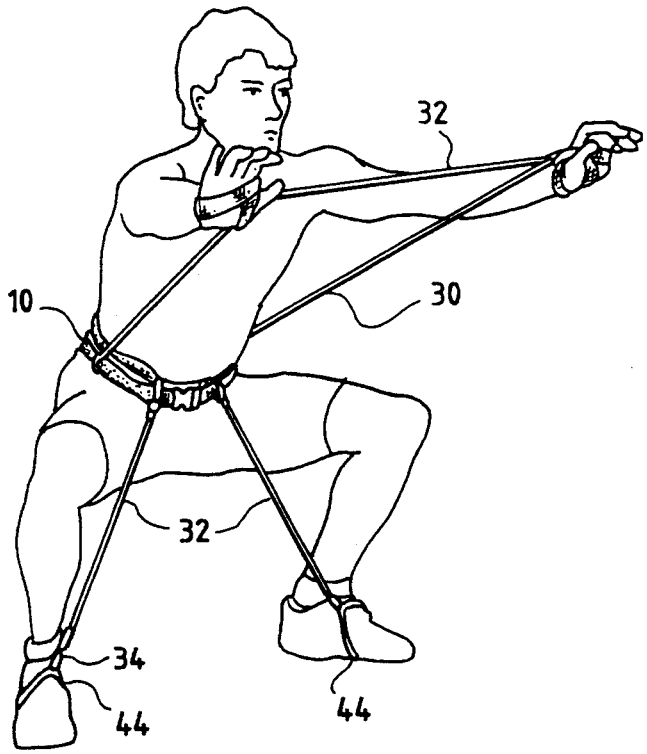
FIG. 11 illustrates a configuration of the belt with multiple elastic cords for use for upper and lower body strength training.

Many other configurations and corresponding exercise motions are possible. FIG. 11 illustrates use of the invention for upper and lower body strength training. By alternately squatting and performing various upper body movements, the user can effectively overload the majority of the major muscle groups of both the upper and lower body. As shown in FIG. 11, elastic cord 30 is passed through all of the attachment loops 20 on belt 10 with each of its cliphooks 34 attached to a hand strap 44 (or wriststrap 36), enabling the user to overload and condition the deltoids, triceps, forearm flexors, trapezius, serratus anterior and pectoral muscles. Another elastic cord 32 is connected to both handstraps 44; by moving the arms laterally apart, the user can overload the major muscles of the back, namely the posterior deltoids, rhomboids, trapezius III and IV, teres major and latissimus dorsi. This combination of elastic cord connections thus allows the user to effectively isolate and overload the majority of the major muscle groups of the upper body for strength training. Finally, FIG. 11 also illustrate the use of a pair of additional elastic cords 32, each connected by cliphooks between one of the anteriormost attachment loops 20 on belt 10 and an attachment loop on a foot strap 44. If heavy resistance tubing is chosen for elastic cords 32, the user in the orientation shown in FIG. 11 can effectively overload the quadriceps, hamstrings and gluteals.

Figure 12:
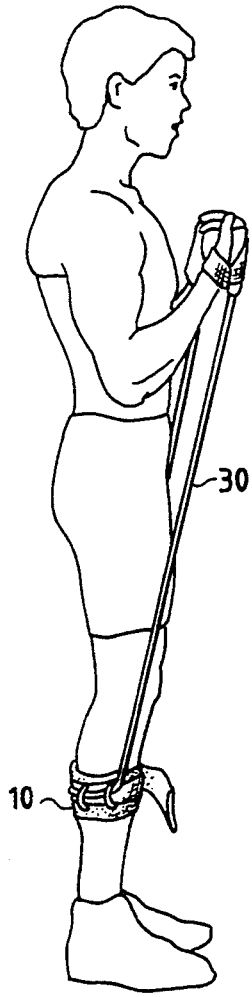
FIG. 12 illustrates use of the belt and elastic cord for a bicep curl exercise.

FIG. 12 illustrates use of the system of the invention for overloading the bicep muscles. For this exercise, belt 10 is placed around the user's legs as shown, rather than around the waist. The position of the belt can be adjusted to vary the angle and resistance, and the exercise can be performed with either alternate or simultaneous motion of the arms.

Figure 13:
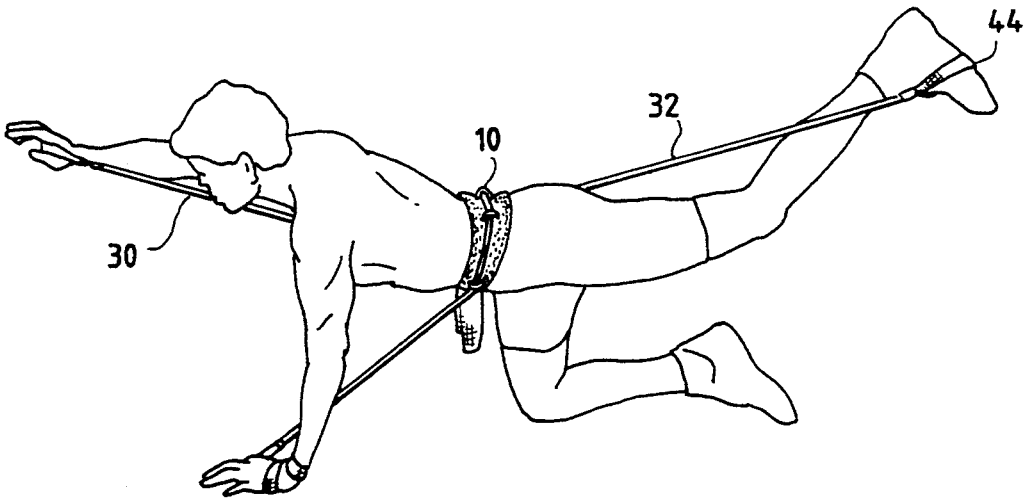
FIG. 13 illustrates use of the belt, elastic cord and hand and foot straps for isolating and conditioning certain muscle groups of the lower body.

FIG. 13 illustrates yet another configuration, this one for isolating and overloading the muscle groups on the back side of the body. In this exercise, contralateral arm/leg patterns are performed where the muscles work against gravity and the elastic resistance provided by the elastic cords attached to belt 10. Elastic cord 30 is passed through all of attachment loops 20 on belt 10 and connected to hand straps 44 or wrist straps 36 for providing resistance to upper body muscles. A second elastic cord 32 of shorter length and greater resistance is connected to one of the rear attachment loops 20 on belt 10 and a foot strap 44 on one foot, to provide resistance for exercising select muscle groups of the buttocks and thighs.

Thus, the system of the invention provides a versatile exercise device which can be readily configured for a wide variety of exercises. While particular embodiments have been described, changes and modifications in these embodiments can be carried out without departing from the scope of the invention, which is intended to be limited only by the scope of the appended claims.

I claim:

1. An exercise system comprising:

a belt for placement about a user's waist;

means for securing the belt about the user's waist;

a resistance means extendable from the belt for exercising the muscles of a user;

wrist strap means having a portion securable around the user's wrist, fastener means for adjustably securing the wrist strap portion around the wrist of the user and connection means for connecting the wrist strap portion to the resistance means to create a resistance load at or below the wrist joint; and thumb loop means attached to the wrist strap means for placement around the user's thumb for facilitating the securing of the wrist strap means on the user's wrist and for orienting and holding the wrist strap to inhibit undesired movement and bear part of the load of the wrist strap means.

2. The system of claim 1 wherein the resistance means comprises an elongated elastomeric member.

3. The system of claim 2 wherein the elongated elastomeric member extends between said belt worn by the user and the wrist strap means such that the user can apply reciprocating force to the elongated elastomeric member while the user's hands remain generally free to thereby reduce injuries associated with gripping.

4. The system of claim 1 wherein the connection means allows the resistance means to be detachable from the wrist strap means and comprises a cliphook affixed to one of the resistance means and the wrist strap portion and an attachment loop affixed to the other of the resistance means and the wrist strap portion and said loop being adapted to detachably receive the cliphook.

5. The system of claim 1 wherein the resistance means includes said resistance means is an elastic member terminating in a pair of ends; and means for detachably connecting the pair of ends of said elastic member to the connection means of the wrist strap.

6. The system of claim 1 wherein the resistance means includes a plurality of rings affixed to and spaced apart generally along the longitudinal axis of the belt, and elongated elastic member being passed through said rings for permitting sliding movement of the elastic member with respect to the belt with the ends of the elastic member being connected to the connection means of the wrist strap means to cause the elastic means to both elongatedly stretch and slide back and forth with respect to the belt.

7. The system of claim 1 wherein the connection means for connection to the resistance means is located in the vicinity of the wrist joint when the wrist strap means is secured by the fastener means around the wrist of the user.

8. The system of claim 7 wherein the connection means is further located along a line extending generally along and below the thumb loop means so that the connection means is located generally at the intersection of the wrist joint and the line extending generally along and below the user's thumb.

9. The system of claim 7 wherein the wrist strap means is formed of a resilient material which can be wrapped around the user's wrist, the thumb loop means comprises a fabric webbing which is secured to the resilient material, and the connection means comprises an attachment ring secured to the resilient material in the vicinity of the wrist joint.

10. The exercise system of claim 1 wherein the resistance means comprises an elongated elastic member having an elongated elastic section which can stretch beyond its original length and terminating in a pair of ends;

means for slidingly receiving the elongated elastic section generally along the longitudinal axis of the belt with the pair of ends extending outwardly from the belt such that reciprocating force applied to the ends causes longitudinal, reciprocating movement of the elastic section with respect to the belt to cause the elastic section to both elongatedly stretch and slide back and forth with respect to the belt; and the connection means of a pair of the wrist strap means being attached to each end of the elongated elastic member for allowing the user to apply reciprocating force thereto.

11. The system of claim 10 wherein said means for slidably receiving the elastic section comprises a plurality of loops attached to and spaced apart along the longitudinal axle of the belt to allow the elastic section to freely slide with respect to the belt.

12. The system of claim 10 further comprising cliphook means attached to each end of the elongated elastic section to allow the elongated elastic member to be replaced.

13. The system of claim 10 wherein said user retention means comprises a wrist strap.

14. The system of claim 13 wherein the wrist strap further comprises loop means for placement around at least one of a user's fingers or thumb for facilitating the securing of the wrist strap on the user's wrist and for orienting and holding the wrist strap to inhibit undesired movement of the wrist strap.

15. The system of claim 13 wherein the wrist strap further comprises means for adjustably securing the strap about the user's wrist.

16. The system of claim 10 wherein the elongated elastic section is an elastic cord with a fabric cover to reduce friction and wear as the elongated elastic section is slidably reciprocated back and forth with respect to the belt.

17. The system of claim 10 wherein the elongated elastic section can stretch in the range of 180% or more in elongation compared to its original length.

18. The system of claim 10 wherein the belt comprises a narrow belt portion and a wide, compressible pad portion attached to the center of the narrow belt portion for providing support to the user's back and reducing slipping of the belt about the user's waist.

19. The system of claim 10 wherein the body side of the belt further includes a rough textured surface on its inner surface adjacent the user's waist to reduce slipping of the belt about the waist of the user.

20. The system of claim 10 wherein the outer surface of the belt has a low surface tension surface for reducing friction wear on the elongated elastic section as said elastic section slides with respect to the belt.

* * * * *